US011333044B2

(12) United States Patent
Kawashima

(10) Patent No.: US 11,333,044 B2
(45) Date of Patent: May 17, 2022

(54) STEAM TURBINE, PARTITION MEMBER, AND METHOD FOR OPERATING STEAM TURBINE

(71) Applicant: MITSUBISHI HEAVY INDUSTRIES COMPRESSOR CORPORATION, Tokyo (JP)

(72) Inventor: Hirokazu Kawashima, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 189 days.

(21) Appl. No.: 16/477,085

(22) PCT Filed: Feb. 10, 2017

(86) PCT No.: PCT/JP2017/004910
§ 371 (c)(1),
(2) Date: Jul. 10, 2019

(87) PCT Pub. No.: WO2018/146792
PCT Pub. Date: Jul. 10, 2019

(65) Prior Publication Data

US 2019/0331004 A1 Oct. 31, 2019

(51) Int. Cl.
*F01K 7/38* (2006.01)
*F01D 9/04* (2006.01)
(Continued)

(52) U.S. Cl.
CPC ..... *F01K 7/38* (2013.01); *F01D 9/04* (2013.01); *F01D 17/145* (2013.01); *F01D 25/24* (2013.01);
(Continued)

(58) Field of Classification Search
CPC ... F01K 7/20; F01K 7/345; F01K 7/38; F01D 9/02; F01D 9/04; F01D 9/047; F01D 9/06;
(Continued)

(56) References Cited

U.S. PATENT DOCUMENTS 2,888,240 A * 5/1959 Fleischmann ..... F01D 25/26 415/108
5,823,742 A * 10/1998 Giddings ..... F01D 17/18 415/150
2013/0243574 A1 9/2013 Jahami

FOREIGN PATENT DOCUMENTS

DE 4344070 A1 7/1994
FR 598829 A 12/1925
(Continued)

OTHER PUBLICATIONS

International Preliminary Report of Patentability with English Translation of Written Opinion corresponding to International Application No. PCT/JP2017/004910, dated Aug. 22, 2019 (17 pages).

*Primary Examiner* — Eldon T Brockman
*Assistant Examiner* — Danielle M. Christensen
(74) *Attorney, Agent, or Firm* — Osha Bergman Watanabe & Burton LLP

(57) ABSTRACT

A steam turbine includes: a partition section that partitions a high-pressure stage and a low-pressure stage; and a pressure regulation valve that regulates a pressure of extraction steam. The pressure regulation valve includes: a plurality of flow rate regulation valves; and a plurality of flow path compartments that correspond to the respective flow rate regulation valves and that communicate with the low-pressure stage side relative to the partition section through respective nozzle holes. The plurality of flow path compartments are arranged over the entire partition section in a circumferential direction in a region including an outer
(Continued)

peripheral side of the pressure regulation valve relative to the partition section as a whole. The partition section includes a bypass passage that makes the high-pressure stage side and the low-pressure stage side communicate with each other without passing through the pressure regulation valve.

9 Claims, 9 Drawing Sheets

(51) Int. Cl.

| | |
|---|---|
| ***F01D 25/24*** | (2006.01) |
| ***F01D 17/14*** | (2006.01) |
| ***F01K 7/34*** | (2006.01) |
| ***F01K 7/20*** | (2006.01) |

(52) U.S. Cl.
CPC ..... *F01K 7/20* (2013.01); *F01K 7/345* (2013.01); *F05D 2220/31* (2013.01); *F05D 2260/606* (2013.01)

(58) Field of Classification Search
CPC ..... F01D 9/065; F01D 17/145; F01D 25/24; F01D 25/26; F01D 25/30; F01D 25/305; F05D 2220/31; F05D 2240/128; F05D 2240/14; F05D 2260/606
See application file for complete search history.

(56) References Cited

FOREIGN PATENT DOCUMENTS

| | | | |
|---|---|---|---|
| JP | S52-107404 | A | 9/1977 |
| JP | S55-164708 | A | 12/1980 |
| JP | 2000-18007 | A | 1/2000 |
| JP | 2012-177340 | A | 9/2012 |

* cited by examiner (COMPARATIVE EXAMPLE)

(COMPARATIVE EXAMPLE)

STEAM TURBINE, PARTITION MEMBER, AND METHOD FOR OPERATING STEAM TURBINE

TECHNICAL FIELD

The present invention relates to a steam turbine including a pressure regulation valve for extraction steam or steam to be mixed, a partition member that partitions a high-pressure section and a low-pressure section inside a cabin, and a method for operating the steam turbine.

BACKGROUND ART

A steam turbine that can extract expanded steam to outside in a middle of expansion while rotating a rotor inside a cabin is well-known (e.g., Patent Literature 1). In the steam turbine, a high-pressure stage and a low-pressure stage are partitioned by a partition plate or a wall of the cabin. A part of the steam passed through the high-pressure stage is extracted as extraction steam to the outside, and remaining steam is introduced to the low-pressure stage by nozzles through a pressure regulation valve.

When a flow rate of the steam to be introduced to the low-pressure stage is regulated by changing an opening of the pressure regulation valve, pressure of the extraction steam can be regulated. A control device regulates the pressure regulation valve and a steam regulation valve that regulates a flow rate of the steam supplied to the high-pressure stage, which makes it possible to control operation of the steam turbine.

The pressure regulation valve to be adopted is of a type that includes a plurality of valves located at a position separated on outer peripheral side relative to the partition plate and flow paths divided corresponding to the respective valves, in addition to a type that is overlaid on the partition plate and uses a rotatable grid valve including a window (Patent Literature 2).

The pressure regulation valve can function also as a pressure regulation valve for steam to be mixed. More specifically, excess steam as steam to be mixed may be made to flow from outside into the steam passed through the high-pressure stage, and the mixed steam may be introduced to the low-pressure stage through the pressure regulation valve and the nozzles.

CITATION LIST

Patent Literature

Patent Literature 1: JP 2012-177340 A
Patent Literature 2: JP 2000-18007 A

SUMMARY OF INVENTION

Technical Problem

To accurately regulate the flow rate of the steam to be introduced from the high-pressure stage to the low-pressure stage through the pressure regulation valve in an operation range, a flow path of the pressure regulation valve is preferably divided into a plurality of compartments, and a plurality of valves corresponding to the respective flow path compartments are preferably used. The plurality of valves are disposed at respective positions separated from an outer end of the partition plate. To secure a cross-sectional area of each of the flow path compartments that introduce the expanded steam passed through the high-pressure stage to the low-pressure stage, the flow path compartments can be arranged over the entire circumference of the partition plate from the positions of the respective valves to an inner end of the partition plate. This, however, increases a case of the pressure regulation valve, which leads to upsizing of the apparatus.

The whole amount of steam introduced from the high-pressure stage to the low-pressure stage flows through the above-described regulation valve, and the regulation valve regulates the flow rate of the steam to be introduced to the low-pressure stage. In this case, in order to cool the low-pressure stage by the steam and to avoid damage of a blade, etc. by air friction, the regulation valve cannot be fully closed, and the minimum lift amount is set in a part of the plurality of valves. The steam thus secured to cool the low-pressure stage normally passes through the pressure regulation valve, and it is unnecessary to regulate the flow rate of the steam. Therefore, there is no reason for the steam to flow through the pressure regulation valve.

On the basis of the fact, an object of the present invention is to provide a steam turbine that has a configuration in which a pressure regulation valve is disposed in a region including an outer peripheral side relative to a partition section and can achieve downsizing, a partition member provided in the steam turbine, and a method for operating the steam turbine.

Solution to Problem

A steam turbine according to the present invention includes a partition section that partitions a high-pressure stage to which steam is supplied, and a low-pressure stage to which the steam passed through the high-pressure stage is introduced, and a pressure regulation valve configured to regulate pressure of extraction steam that is a part of the steam passed through the high-pressure stage or pressure of steam to be mixed flowing from outside into the steam passed through the high-pressure stage.

The pressure regulation valve includes a plurality of flow rate regulation valves that are located on outer peripheral side relative to the partition section and to which the steam is guided from the high-pressure stage side relative to the partition section, and a plurality of flow path compartments that correspond to the respective flow rate regulation valves and communicate with the low-pressure stage side relative to the partition section through respective nozzle holes.

The plurality of flow path compartments are arranged over the entire partition section in a circumferential direction in a region including the outer peripheral side relative to the partition section as a whole.

In the present invention, the partition section includes a bypass passage that makes the high-pressure stage side and the low-pressure stage side communicate with each other without passing through the pressure regulation valve.

In the steam turbine according to the present invention, the pressure regulation valve preferably includes a flow path that guides the steam from the high-pressure stage side to a predetermined position separated outward in a radial direction from an outer end of the partition section, the plurality of flow rate regulation valves provided at the predetermined position, and the plurality of flow path compartments that guide the steam passed through the flow rate regulation valve to the low-pressure stage. The plurality of flow path compartments preferably include first parts that extend in parallel from the position of the flow rate regulation valves toward the partition section, second parts that are formed by dividing, in the circumferential direction, a space between a high-pressure side partition part of the partition section facing the high-pressure stage and a low-pressure side partition part of the partition section facing the low-pressure stage, and nozzle holes (nozzles) for the steam that are prepared for the respective flow path compartments and lead from the respective second parts to the low-pressure stage side.

In the steam turbine according to the present invention, the partition section is preferably a partition member that is formed integrally with a cabin accommodating the high-pressure stage and the low-pressure stage, or a partition member provided separately from the cabin. The partition section preferably includes a high-pressure side partition part facing the high-pressure stage and a low-pressure side partition part facing the low-pressure stage. The bypass passage preferably includes openings that make the high-pressure stage side relative to the high-pressure side partition part and a bypass gap located between the high-pressure side partition part and the low-pressure side partition part, communicate with each other, and a bypass introduction passage for the steam that leads from the bypass gap to the low-pressure stage side.

In the steam turbine according to the present invention, the partition section is preferably a partition member that is formed integrally with a cabin accommodating the high-pressure stage and the low-pressure stage, or a partition member provided separately from the cabin. The partition section preferably includes a high-pressure side partition part facing the high-pressure stage and a low-pressure side partition part facing the low-pressure stage. The bypass passage preferably includes openings that make the high-pressure stage side relative to the high-pressure side partition part and the second parts located between the high-pressure side partition part and the low-pressure side partition part, communicate with each other, and the nozzle holes that lead from the respective second parts to the low-pressure stage side.

In the steam turbine according to the present invention, the openings are preferably distributed over an entire circumference or a part of the circumference of the high-pressure side partition part.

The steam turbine according to the present invention preferably further includes a control unit configured to increase or decrease an opening of each of the plurality of flow rate regulation valves. The control unit preferably regulates the flow rate of the steam to be introduced to the low-pressure stage through the pressure regulation valve, from a minimum flow rate when the plurality of flow rate regulation valves are all fully closed to a maximum flow rate when the plurality of flow rate regulation valves are all fully opened.

Further, according to the present invention, there is provided a partition member for a steam turbine that partitions a high-pressure stage to which steam is supplied and a low-pressure stage to which the steam passed through the high-pressure stage is introduced, and is used in the steam turbine including a pressure regulation valve configured to regulate pressure of extraction steam or pressure of steam to be mixed. The partition member includes a bypass passage configured to make the high-pressure stage side and the low-pressure stage side communicate with each other without passing through the pressure regulation valve that is disposed in a region including outer peripheral side relative to the partition member.

The partition member for the steam turbine according to the present invention preferably further includes a high-pressure side partition part facing the high-pressure stage, and a low-pressure side partition part facing the low-pressure stage. The bypass passage preferably includes openings that make the high-pressure stage side relative to the high-pressure side partition part and a gap between the high-pressure side partition part and the low-pressure side partition part, communicate with each other, and a nozzle hole for the steam that leads from the gap to the low-pressure stage side.

In the partition member for the steam turbine according to the present invention, the openings are preferably distributed over an entire circumference or a part of the circumference of the high-pressure side partition part.

Next, according to the present invention, there is provided a method for operating a steam turbine. The steam turbine includes a partition section that partitions a high-pressure stage to which steam is supplied, and a low-pressure stage to which the steam passed through the high-pressure stage is introduced, and a pressure regulation valve configured to regulate pressure of extraction steam that is a part of the steam passed through the high-pressure stage. The method includes controlling the pressure of the extraction steam by regulating a flow rate of the steam to be introduced to the low-pressure stage through the pressure regulation valve that is disposed in a region including outer peripheral side relative to the partition section, and constantly introducing the steam from the high-pressure stage side to the low-pressure stage side through a bypass passage provided in the partition section without passing through the pressure regulation valve while the high-pressure stage and the low-pressure stage are rotated.

Further, according to the present invention, there is provided a method for operating a steam turbine. The steam turbine includes a partition section that partitions a high-pressure stage to which steam is supplied, and a low-pressure stage to which the steam passed through the high-pressure stage is introduced, and a pressure regulation valve configured to regulate pressure of steam to be mixed flowing from outside into the steam passed through the high-pressure stage. The method includes controlling the pressure of the steam to be mixed by regulating a flow rate of the steam to be introduced to the low-pressure stage through the pressure regulation valve disposed in a region including outer peripheral side relative to the partition section, and constantly introducing the steam from the high-pressure stage side to the low-pressure stage side through a bypass passage provided in the partition section without passing through the pressure regulation valve while the high-pressure stage and the low-pressure stage are rotated.

In the method for operating the steam turbine according to the present invention, even when the flow rate of the steam to be introduced to the low-pressure stage through the pressure regulation valve is insufficient for a predetermined flow rate necessary to cool the low-pressure stage, the predetermined flow rate of the steam to be introduced to the low-pressure stage is preferably secured by the steam introduced to the low-pressure stage side through the bypass passage.

Advantageous Effects of Invention

According to the present invention, the flow rate of the steam passing through the pressure regulation valve is reduced by the flow rate of the steam passing through the bypass passage from the high-pressure stage side to the low-pressure stage side. Therefore, it is possible to reduce the flow path cross-sectional area of the pressure regulation valve disposed over the circumferential direction in the region including the outer peripheral side relative to the partition section and to achieve downsizing of the steam turbine.

In addition, the bypass passage that introduces the steam to the low-pressure stage without passing through the pressure regulation valve is provided, which makes it possible to secure the flow rate of the steam necessary to cool the low-pressure stage even when failure of the pressure regulation valve, etc. occurs.

DESCRIPTION OF EMBODIMENTS

An embodiment of the present invention is described below with reference to accompanying drawings.

Figure 1:
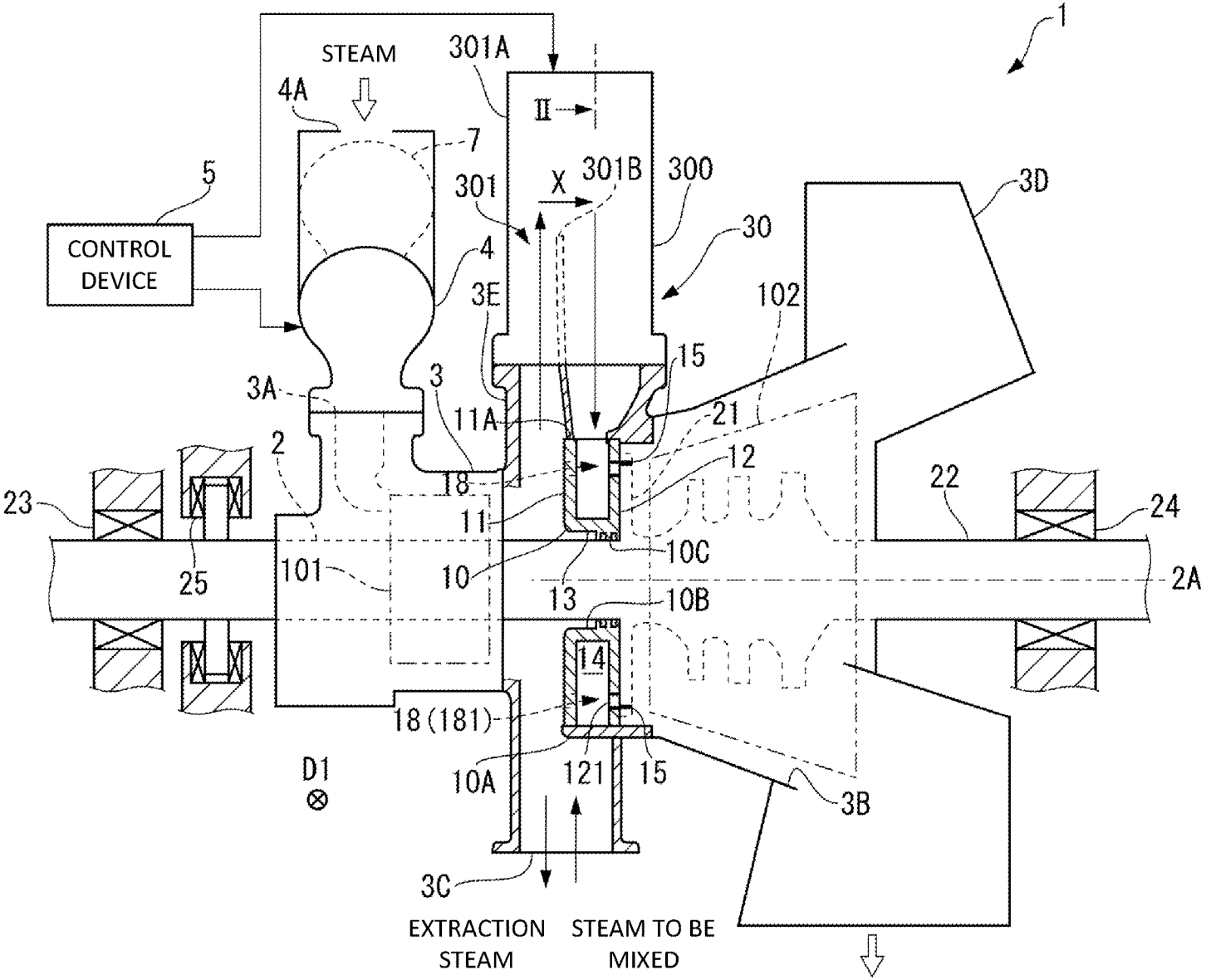
FIG. 1 is a diagram schematically illustrating a steam turbine according to an embodiment of the present invention in a manner that a partition plate and its vicinity are cut away.

A steam turbine 1 illustrated in FIG. 1 includes a rotor 2, a cabin 3 accommodating the rotor 2, a steam supply valve 4 supplying steam to an inside of the cabin 3, a partition plate 10 (partition section) partitioning the inside of the cabin 3, a pressure regulation valve 30, and a control device 5 (control unit).

The steam turbine 1 injects, to a blade, steam that is supplied from an unillustrated boiler, etc. to the inside of the cabin 3 through the steam supply valve 4, to rotate the rotor 2, and outputs rotation power of the rotor 2 to a generator, a compressor, etc. that are not illustrated.

A high-pressure stage 101 includes rotor blades (not illustrated) and stator blades (not illustrated). The rotor blades are fixed to the rotor 2 and are rotated together with the rotor 2. The stator blades are provided on an inner wall of the cabin 3. Likewise, a low-pressure stage 102 includes a rotor blade and a stator blade.

The partition plate 10 partitions the high-pressure stage 101 and the low-pressure stage 102, and is erected so as to be orthogonal to an axis 2A of the rotor 2.

Each of the high-pressure stage 101 and the low-pressure stage 102 has a multistage configuration including the plurality of rotor blades and the plurality of stator blades.

Steam is expanded while being injected in each of the stages from the high-pressure stage 101 to the low-pressure stage 102. Accordingly, the low-pressure stage 102 is larger in diameter than the high-pressure stage 101.

A rotary shaft 22 that extends in a horizontal direction along the axis 2A of the rotor 2 is rotatably supported by journal bearings 23 and 24, and is supported by a thrust bearing 25 in a thrust direction. The journal bearings 23 and 24 are located at respective ends of the rotary shaft 22. The thrust bearing 25 is located on one end side of the rotary shaft 22. A generator or the like is connected to the other end side of the rotary shaft 22.

The cabin 3 includes a steam inlet 3A through which high-temperature high-pressure steam flows into a first stage of the high-pressure stage 101, a steam outlet 3B through which the steam flows out from a final stage of the low-pressure stage 102 to the outside, and a port 3C for extraction steam and steam to be mixed. The port 3C allows the steam to flow out from or flow into a space between the high-pressure stage 101 and the low-pressure stage 102.

The steam supply valve 4 provided at an upper part of the cabin 3 on the one end side (upstream side) can regulate a flow rate of the steam supplied to the high-pressure stage 101 through the steam inlet 3A.

An outlet flow path part 3D is provided on the other end side of the cabin 3 at which the steam outlet 3B is located, so as to protrude from the cabin 3 to an outer peripheral side.

The steam supply valve 4 supplies the high-temperature high-pressure steam that has flowed from an input port 4A connected to the boiler or the like, to the high-pressure stage 101 inside the cabin 3 through the steam inlet 3A. The steam supply valve 4 can regulate the flow rate of the steam supplied to the high-pressure stage 101.

A shutoff valve 7 that shuts off the supply of the steam from the input port 4A when operation of the steam turbine 1 is stopped or in an emergency, is provided at the prestage of the steam supply valve 4.

The port 3C for extraction steam and steam to be mixed is open toward an outer peripheral direction directly below the partition plate 10. The pressure regulation valve 30 is disposed over the entire partition plate 10 in a circumferential direction in a region including the outer peripheral side relative to the partition plate 10.

Pressure of extraction steam extracted to the outside of the cabin 3 through the port 3C and the pressure of steam to be mixed flowing into the cabin 3 from the outside through the port 3C can be regulated by the pressure regulation valve 30.

Under the operation control of the control device 5, the flow rate of the steam passing through the steam supply valve 4 and the flow rate of the steam passing through the pressure regulation valve 30 are regulated. As a result, output of the steam turbine 1 corresponding to the rotation speed of the rotor 2 and the pressure of the extraction steam or the pressure of the steam to be mixed are regulated.

In the following, an example in which the steam is extracted through the port 3C is described. The steam is mixed through the port 3C in a similar manner. The steam turbine 1 may be used only for extraction steam, only for steam to be mixed, or may be used by switching the extraction steam and the steam to be mixed.

Figure 3:
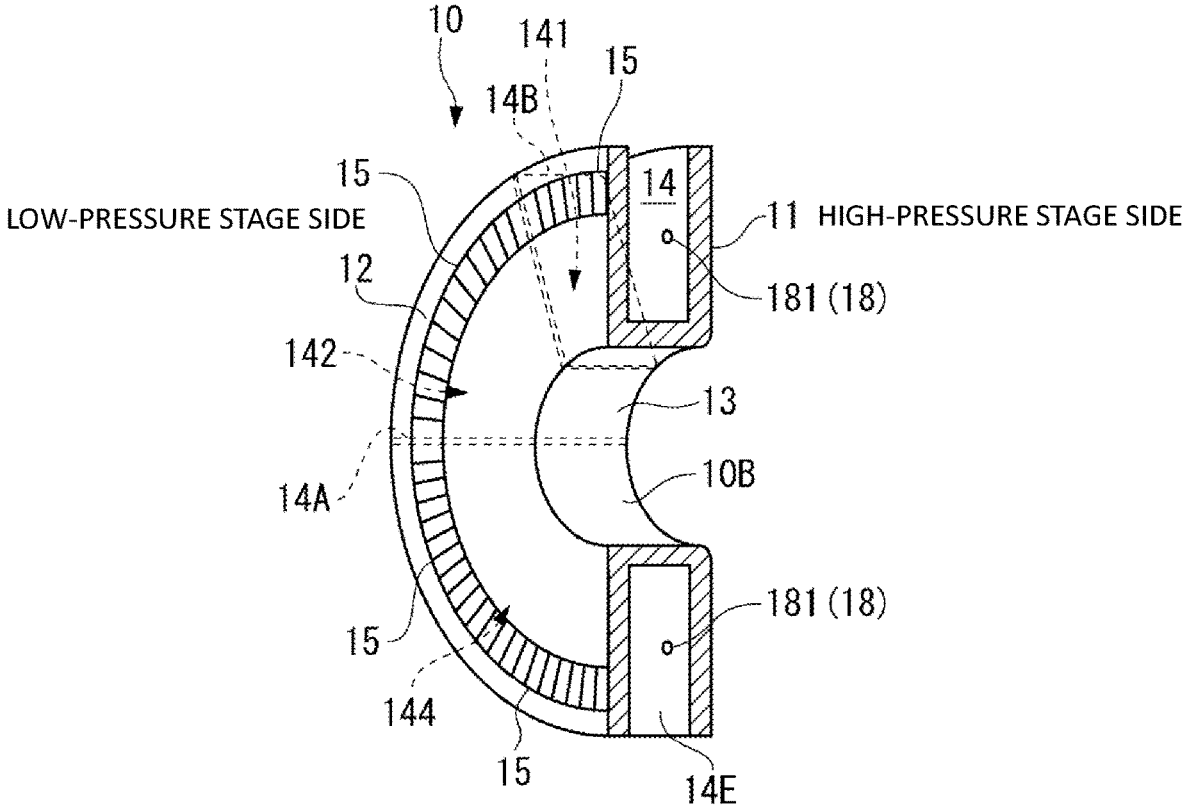
FIG. 3 is a perspective view illustrating an outline shape of a half-split body of the partition plate (as viewed from low-pressure stage side).

As illustrated in FIG. 1 and FIG. 3, the partition plate 10 includes a high-pressure side partition part 11 facing the high-pressure stage 101 and a low-pressure side partition part 12 facing the low-pressure stage 102. The partition plate 10 is disposed inside the cabin 3. An upper part of the partition plate 10 is accommodated in an accommodation portion 3E provided in the cabin 3.

The partition plate 10 is provided separately from the cabin 3. The high-pressure side partition part 11 and the low-pressure side partition part 12 are connected on the inner peripheral side through a connection part 13, and are integrally configured. The partition plate 10 is an annular member having a substantially U-shaped cross-section.

A gap 14 is provided in the axis 2A direction between the high-pressure side partition part 11 and the low-pressure side partition part 12.

A lower end part 10A (FIG. 1) of the partition plate 10 is supported by the inner peripheral part of the cabin 3.

Figure 2:
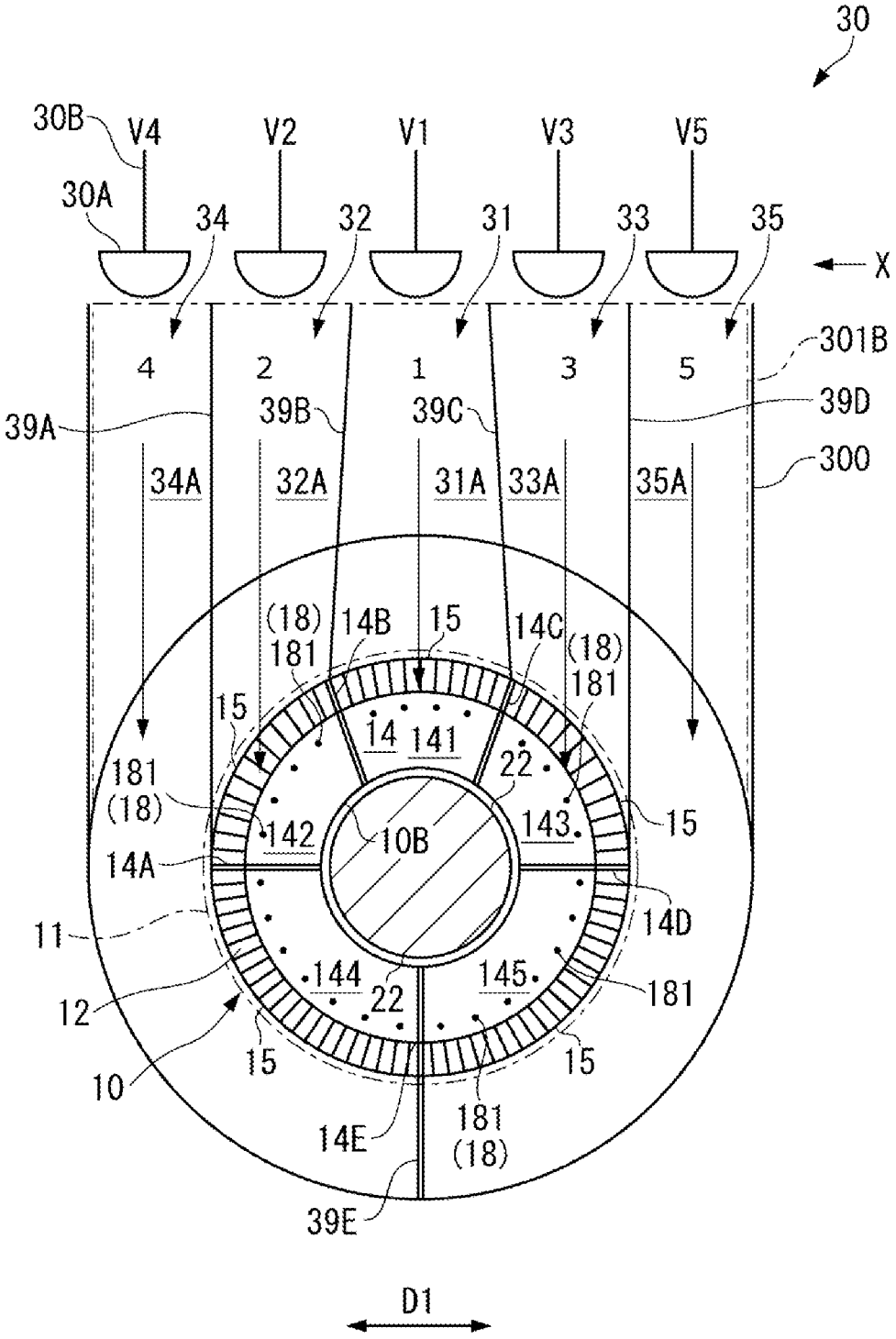
FIG. 2 is a schematic diagram illustrating a pressure regulation valve and the partition plate as viewed from a direction illustrated by an arrow II in FIG. 1.

FIG. 3 illustrates a half-split body corresponding to a half part of the partition plate 10. The partition plate 10 includes a pair of half-split bodies. The rotary shaft 22 is inserted into a circular opening formed by an inner end 10B of the partition plate 10 when the pair of half-split bodies are assembled from a front side and a rear surface side on a paper surface of FIG. 1. The inner end 10B of the partition plate 10 and the outer peripheral part of the rotary shaft 22 configure a labyrinth seal 10C (FIG. 1). In FIG. 3 and FIG. 2, illustration of the labyrinth seal 10C is omitted.

As described later, the steam on the high-pressure stage 101 side relative to the partition plate 10 flows into the gap 14 between the high-pressure side partition part 11 and the low-pressure side partition part 12 through opening valves among a plurality of valves of the pressure regulation valve 30.

As illustrated in FIG. 3 and FIG. 2, the gap 14 is divided into a plurality of parts 141 to 145 in the circumferential direction by bulkheads 14A to 14E provided between the high-pressure side partition part 11 and the low-pressure side partition part 12.

A proportion of each of the parts 141 to 145 divided by the bulkheads 14A to 14E can be appropriately determined.

Nozzles 15 (nozzle holes) leading to the low-pressure stage 102 communicate with the respective gap parts 141 to 145. At least one nozzle 15 may communicate with each of the parts 141 to 145.

The nozzles 15 are provided in the low-pressure side partition part 12 so as to penetrate through the low-pressure side partition part 12 in a thickness direction, and the steam is injected from the nozzle 15 toward the first stage of the low-pressure stage 102.

A plurality of through holes 181 each penetrating through the high-pressure side partition part 11 in a thickness direction are provided in the high-pressure side partition part 11. In FIG. 2, the through holes 181 are illustrated by black dots. As described later, the through holes 181 configure a bypass passage 18 that makes the high-pressure stage 101 side and the low-pressure stage 102 side directly communicate with each other.

Next, the pressure regulation valve 30 is described with reference to FIG. 1 and FIG. 2.

The pressure regulation valve 30 includes an upward flow path 301 (FIG. 1), a plurality of flow rate regulation valves V1 to V5 (FIG. 2), a plurality of flow path compartments 31 to 35 (FIG. 2), and a casing 300 (FIG. 1). The upward flow path 301 guides the steam from the high-pressure stage 101 side to an upper position X. The plurality of flow rate regulation valves V1 to V5 are disposed at the position X. The plurality of flow path compartments 31 to 35 respectively correspond to the flow rate regulation valves V1 to V5. The casing 300 accommodates the whole components of the pressure regulation valve 30.

The casing 300 is fastened to the outer peripheral part of the cabin 3.

As illustrated in FIG. 1, the upward flow path 301 is sectioned among a wall 301A, an upper part of the high-pressure side partition part 11, and a plate 301B, near the final stage of the high-pressure stage 101. The wall 301A rises over the accommodation portion 3E and the casing 300. The plate 301B is continued upward from the upper part of the high-pressure side partition part 11. The upward flow path 301 guides the steam passed through the high-pressure stage 101, from the upper part in the cabin 3 to the flow rate regulation valves V1 to V5 (FIG. 2), beyond an outer end 11A of the high-pressure side partition part 11. The flow rate regulation valves V1 to V5 are disposed at the position X that is separated outward in a radial direction of the partition plate 10 from the outer end 11A.

The upward flow path 301 is located on front side relative to the paper surface of FIG. 2, and an upper end of the upward flow path 301 or its vicinity corresponds to the position X.

As illustrated in FIG. 2, the flow rate regulation valves V1 to V5 are arranged at the position X in a width direction D1 of the partition plate 10. The direction in which the flow rate regulation valves V1 to V5 are arranged corresponds to a direction orthogonal to the paper surface of FIG. 1.

Each of the flow rate regulation valves V1 to V5 includes a valve disc 30A and a valve stem 30B supporting the valve disc 30A. When the valve stem 30B is advanced/retracted by an unillustrated driving mechanism, a dimension of a gap between the valve disc 30A and an unillustrated valve seat is changed, and an opening of each of the flow rate regulation valves V1 to V5 is changed.

The flow path compartments 31 to 35 guide the steam passed through the respective flow rate regulation valves V1 to V5 to the low-pressure stage 102. FIG. 2 illustrates numbers "1" to "5" respectively corresponding to the flow path compartments 31 to 35.

The plurality of flow path compartments 31 to 35 include first parts 31A, 32A, 33A, 34A and 35A, the parts 141 to 145 (hereinafter, second parts), and the above-described nozzles 15. The first parts 31A, 32A, 33A, 34A, and 35A extend in parallel downward from the respective positions of the flow rate regulation valves V1 to V5 to the partition plate 10. The parts 141 to 145 are formed by dividing the gap 14 between the high-pressure side partition part 11 and the low-pressure side partition part 12 as described above. The nozzles 15 are prepared for the respective flow path compartments 31 to 35.

The flow path compartments 31 to 35 are arranged over the entire circumference of the partition plate 10 in the region including the outer peripheral side relative to the partition plate 10, as a whole.

Even in a case where the flow path compartments 31 to 35 cannot be arranged over the entire circumference because any member is disposed in a part of the circumference of the partition plate 10, the flow path compartments 31 to 35 are arranged over the entire partition plate 10 in the circumferential direction in the region including the outer peripheral side relative to the partition plate 10 except for the part of the circumferential direction.

The first parts 31A, 32A, 33A, 34A, and 35A are formed by dividing, by bulkheads 39A to 39D (FIG. 2), a space between the above-described plate 301B (FIG. 1) and an outer wall of the casing 300 into a plurality of parts in the width direction D1.

The first part 31A corresponding to the flow rate regulation valve V1 located at a center in the width direction D1 extends downward toward the gap 14 between the bulkhead 39B and the bulkhead 39C, and is continued to the second part 141. The first part 31A and the second part 141 form a continuous flow path.

The first parts 32A and 33A respectively corresponding to the flow rate regulation valves V2 and V3 adjacent to the flow rate regulation valve V1 in FIG. 2 are similarly configured. The first part 32A is continuous with the second part 142, and the first part 33A is continuous with the second part 143.

The first part 34A corresponding to the flow rate regulation valve V4 located at left end in FIG. 2 is formed between the bulkhead 39A and the outer wall of the casing 300 and on the left side of the gap 14 of the partition plate 10, and is continuous with the second part 144.

In other words, the flow path compartment 34 configured of the first part 34A and the second part 144 is sectioned by the bulkhead 39A, the casing 300, the bulkhead 14A in the gap 14, and a bulkhead 39E located at a lower end inside the casing 300.

The first part 35A corresponding to the flow rate regulation valve V5 located at right end is formed between the bulkhead 39D and the outer wall of the casing 300 and on the right side of the gap 14 of the partition plate 10, and is continuous with the second part 145.

As described above, the flow path compartments 31 to 35 individually lead to the low-pressure stage 102 through the respective nozzles 15 (FIG. 3) provided in the second parts 141 to 145. The steam passed through the opening valves among the flow rate regulation valves V1 to V5 is introduced to the low-pressure stage 102 through the corresponding compartments among the flow path compartments 31 to 35.

For example, the steam passed through the flow rate regulation valve V1 flows into the first part 31A and the second part 141, and is introduced from the second part 141 to the low-pressure stage 102 through the nozzle 15. This is true of the flow rate regulation valves V2 to V5.

The opening of each of the plurality of flow rate regulation valves V1 to V5 is increased or decreased based on an instruction that is transmitted from the control device 5 (FIG. 1) to the driving mechanism of the corresponding valve stem 30B.

The opening of each of the flow rate regulation valves V1 to V5 is individually increased or decreased under the control of the control device 5, which enables regulation of the flow rate of the steam to be introduced to the low-pressure stage 102, as a whole of the pressure regulation valve 30.

For example, the flow rate regulation valve V5 may be fully opened, the flow rate regulation valve V4 may be opened at a predetermined opening, and the remaining valves V1 to V3 may be fully closed. Alternatively, the flow rate regulation valves V5, V4, V3, and V2 may be fully opened, and the flow rate regulation valve V1 may be opened at a predetermined opening. As described above, the flow rate regulation valves V5, V4, V3, V2, and V1 are used in this order and the opening of each of the flow rate regulation valves is adjusted. As a result, the control device 5 can regulate the flow rate of the steam to be introduced to the low-pressure stage 102 through the pressure regulation valve 30 based on a necessary flow rate, from the minimum flow rate when the flow rate regulation valves V1 to V5 are all fully closed to the maximum flow rate when the flow rate regulation valves V1 to V5 are all fully opened.

As with the pressure regulation valve 30, the above-described steam supply valve 4 (FIG. 1) also includes a plurality of flow rate regulation valves and a plurality of flow path compartments sectioned in the circumferential direction, and can regulate the flow rate based on the opening of each of the flow rate regulation valves.

For example, there is a case where the flow rate regulation valves V1 to V4 of the pressure regulation valve 30 are fully closed and the flow rate regulation valve V5 is set to an opening close to full closing in order to perform control to increase the flow rate of the extraction steam extracted to the outside through the port 3C during operation of the steam turbine 1, or there is a case where the flow rate regulation valves V1 to V5 of the pressure regulation valve 30 are fully closed due to failure and the introduction of the steam to the low-pressure stage 102 through the pressure regulation valve 30 is shut off. In such a case, if the rotor 2 is rotated while the steam to cool the low-pressure stage 102 is not introduced or the amount of the introduced steam is insufficient for the predetermined amount necessary to cool the low-pressure stage 102, the blade, etc. of the low-pressure stage 102 may be damaged by air friction.

To avoid the above-described damage, it is considered that a mechanical stopper is provided on the flow rate regulation valve V5 of the pressure regulation valve 30 corresponding to the flow path compartment 35 to set the minimum lift amount, and the flow rate of the steam necessary to cool the low-pressure stage 102 is constantly secured. The steam secured for cooling, however, normally passes through the flow rate regulation valve V5. Accordingly, it is unnecessary for the steam to flow through the pressure regulation valve 30 in the first place.

Therefore, the present embodiment is mainly characterized in that the partition plate 10 includes the bypass passage 18 (FIG. 1 to FIG. 3) making the high-pressure stage 101 side and the low-pressure stage 102 side communicate with each other without passing through the pressure regulation valve 30. The bypass passage 18 is normally open. Therefore, the bypass passage 18 constantly introduces the steam from the high-pressure stage 101 to the low-pressure stage 102 without passing through the pressure regulation valve 30 while the rotor 2 is rotated and the steam is supplied to the high-pressure stage 101 through the steam supply valve 4.

It is unnecessary to provide the stopper to set the minimum lift amount in the pressure regulation valve 30 because the bypass passage 18 is provided.

The bypass passage 18 includes the through holes 181 (openings) each penetrating through the high-pressure side partition part 11 in the thickness direction, and the gap 14 and the nozzles 15 (FIG. 2) that communicate with each other through the through holes 181. The through holes 181 are distributed over the entire circumference of the high-pressure side partition part 11.

An opening area of each of the through holes 181 can be appropriately determined by taking into consideration the flow rate of the steam necessary to cool the low-pressure stage 102 through the through holes 181. Note that the illustrated distribution of the through holes 181 is merely illustrative, and the positions of the respective through holes 181 can be appropriately determined.

In place of formation of the through holes 181 each having the same diameter in the high-pressure side partition part 11, providing a valve sheet with a diffuser in the high-pressure side partition part 11 makes it possible to provide the openings of the bypass passage 18 in the high-pressure side partition part 11. The valve sheet with the diffuser throttles the steam received from the wide inlet once, and then expands the steam toward the outlet and injects the expanded steam to the low-pressure stage side.

As with the present embodiment, when the positions of the respective through holes 181 are set on the inside of the positions of the nozzles 15 in the radial direction and the nozzles 15 are prevented from being directly exposed to the steam injected from the through holes 181, the steam that has entered the second parts 141 to 145 through the flow rate regulation valves V1 to V5 can smoothly flow out from the second parts 141 to 145 through the nozzles 15, and deposition of droplets on the nozzles 15 can be prevented.

Note that the positions of the respective through holes 181 and the positions of the respective nozzles 15 are shifted in the circumferential direction while being set at the same position in the radial direction of the partition plate 10, which makes it possible to prevent the nozzles 15 from being directly exposed to the steam injected from the through holes 181.

When the through holes 181 are open in the high-pressure side partition part 11, a part of the steam introduced from the high-pressure stage 101 side to the low-pressure stage 102 side flows into the through holes 181 without passing through the pressure regulation valve 30. The steam flowed into each of the plurality of through holes 181 is introduced to the low-pressure stage 102 through the nozzles 15 that communicate with the respective second parts 141 to 145.

When the through holes 181 are distributed over the entire circumference, the steam flows into the partition plate 10 through the through holes 181 uniformly in the circumferential direction. This makes it possible to prevent a local impact load from being applied to the partition plate 10.

Further, it is possible to perform uniform warming up through the through holes 181 when operation of the steam turbine 1 is started.

The steam introduced to the low-pressure stage 102 through the bypass passage 18 without passing through the pressure regulation valve 30 is directly introduced from the high-pressure stage 101 side to the low-pressure stage 102 side along the axis 2A. Therefore, the pressure loss is small.

Figure 8:
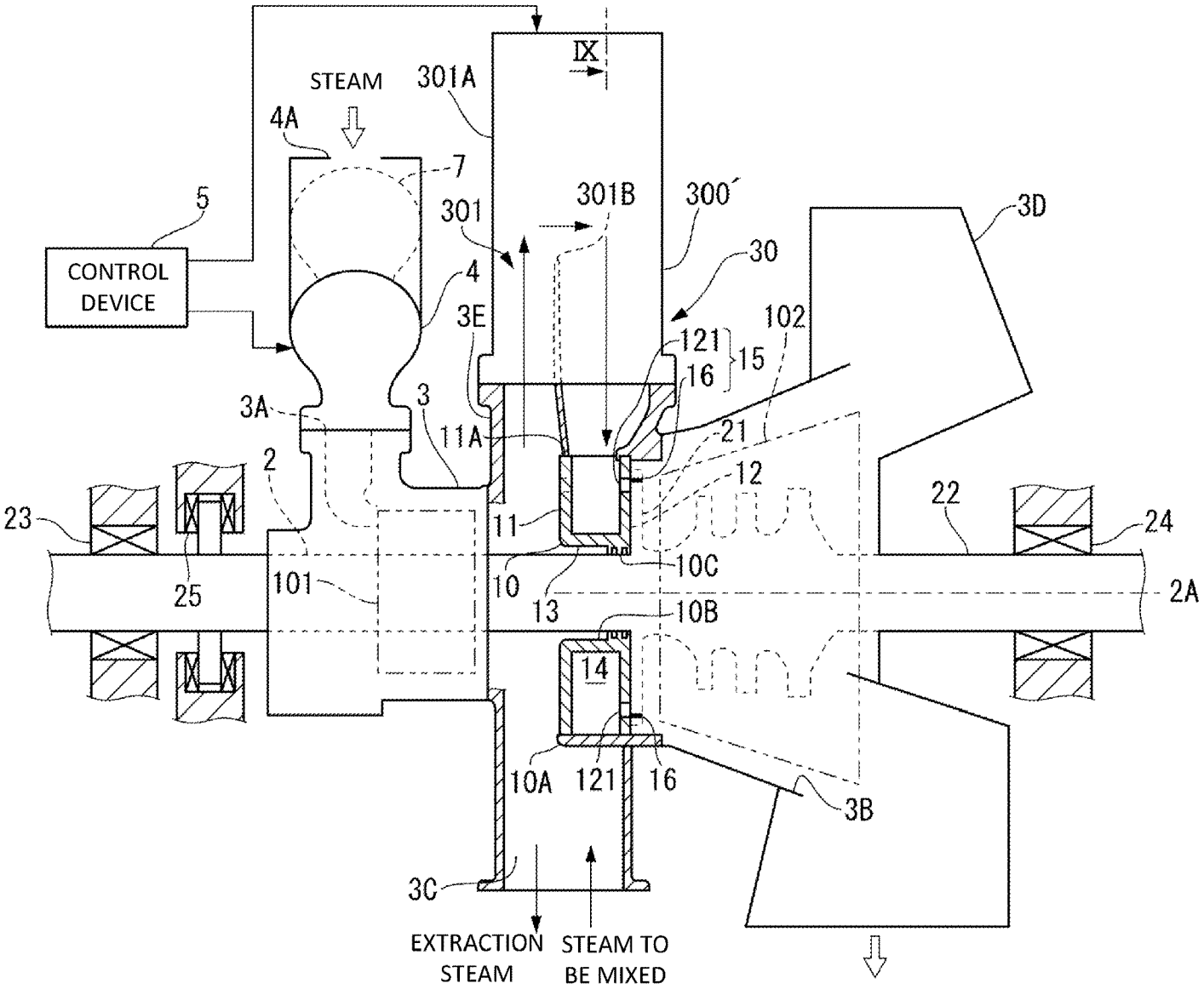
FIG. 8 is a diagram schematically illustrating a steam turbine according to a comparative example.
Figure 9:
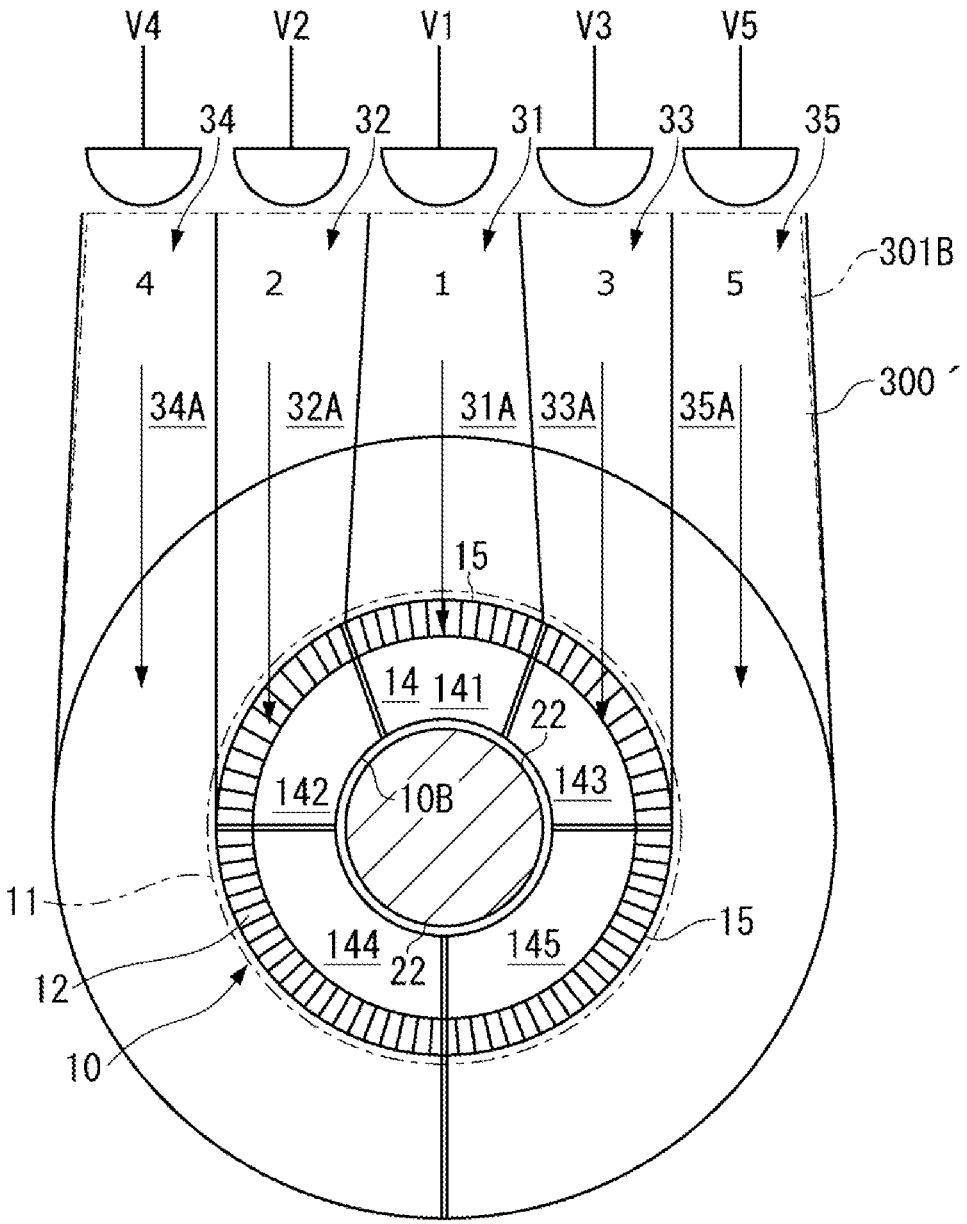
FIG. 9 is a schematic diagram illustrating a pressure regulation valve and a partition plate as viewed from a direction illustrated by an arrow IX in FIG. 8.

FIG. 8 and FIG. 9 each illustrate an example (comparative example) in which the minimum lift amount is set to the flow rate regulation valve V5 to secure the steam to cool the low-pressure stage 102 without the bypass passage 18. In the comparative example, the through holes 181 are not provided in the high-pressure side partition part 11, and the whole amount of the steam introduced from the high-pressure stage 101 to the low-pressure stage 102 passes through the pressure regulation valve 30.

In the present embodiment (FIG. 1 to FIG. 3), the flow rate of the steam passing through the pressure regulation valve 30 is small as compared with the comparative example (FIG. 8 and FIG. 9) by the amount of the steam introduced to the low-pressure stage 102 through the bypass passage 18. This makes it possible to make the cross-sectional area of the upward flow path 301 of the pressure regulation valve 30 through which the steam flows and the flow path cross-sectional area of each of the flow path compartments 31 to 35 small as compared with the comparative example. For example, the cross-sectional area of each of the flow path compartments 31 to 35 can be made small in the radial direction (including width direction D1) and in the axis 2A direction. Further, since the cross-sectional area of the flow path is small, the flow rate regulation valves V1 to V5 can be made small.

The dimension of the casing 300 that includes the flow path and the valve disc of the pressure regulation valve 30 according to the present embodiment is smaller than a dimension of a casing 300' according to the comparative example both in the axis 2A direction and the radial direction.

According to the present embodiment, since the casing 300 is short in the axis 2A direction, it is possible to reduce the length of the rotary shaft 22 or to secure a space for increase of the number of stages inside the cabin 3. When the length of the rotary shaft 22 is small, it is possible to reduce the diameter of the rotary shaft 22 while securing rigidity. This makes it possible to achieve downsizing in the radial direction and to suppress a cost of a bearing, etc. as well.

According to the present embodiment, the bypass passage 18 is provided in the partition plate 10, which makes it possible to reduce the flow path cross-sectional area of the pressure regulation valve 30 because the flow rate of the steam passing through the pressure regulation valve 30 is reduced, and to set the flow path of the pressure regulation valve 30 with use of the entire circumference on the outer peripheral side relative to the partition plate 10. As a result, it is possible to suppress the size of the casing 300 including the flow path of the pressure regulation valve 30 and to achieve downsizing of the steam turbine 1 device.

In addition, even if the flow rate of the steam passing through the pressure regulation valve 30 is insufficient for the flow rate necessary to cool the low-pressure stage 102, or even if the pressure regulation valve 30 is fully closed due to failure, the predetermined flow rate of the steam necessary to cool the low-pressure stage 102 can be secured by the steam introduced to the low-pressure stage 102 side through the bypass passage 18, irrespective of such a situation. As a result, it is possible to improve reliability of the steam turbine 1.

The bypass flow rate of the steam through the bypass passage 18 of the partition plate 10 is determined based on a capacity of the steam turbine 1. When the rotation speed of the rotor 2 is increased due to increase of the capacity of the steam turbine 1, the flow rate of the steam necessary to cool the low-pressure stage 102 is also increased. If the minimum lift amount is set to the flow rate regulation valve V5 without providing the bypass passage 18 in the partition plate 10 as with the comparative example (FIG. 8 and FIG. 9), a flow rate ratio of the cooling steam in the total flow rate of the steam to be introduced to the low-pressure stage 102 is increased when the capacity is increased. Therefore, the flow rate equal to or larger than the flow rate when the flow rate regulation valve V5 is fully opened is necessary. As described above, the downsizing effect is large as the necessary bypass flow rate is large, because the bypass passage 18 of the partition plate 10 covers the bypass flow rate.

Further, providing the partition plate 10 according to the present embodiment in the cabin 3 in place of the existing partition plate of the steam turbine makes it possible to increase the capacity of the steam turbine. At this time, it is unnecessary to particularly change control of the pressure regulation valve 30.

The partition plate 10 provided in the existing apparatus in place of the existing partition plate may be a newly-manufactured partition plate 10 or a partition plate 10 that is obtained by providing the bypass passage 18 in the partition plate removed from the existing apparatus. Since the second parts 141 to 145 that configure the flow path compartments 31 to 35 of the pressure regulation valve 30 and the plurality of nozzles 15 are used as a part of the configuration of the bypass passage 18, the partition plate 10 according to the present embodiment can be easily obtained only by providing the through holes 181 in the existing partition plate including the second parts 141 to 145 and the plurality of nozzles 15.

Figure 4:
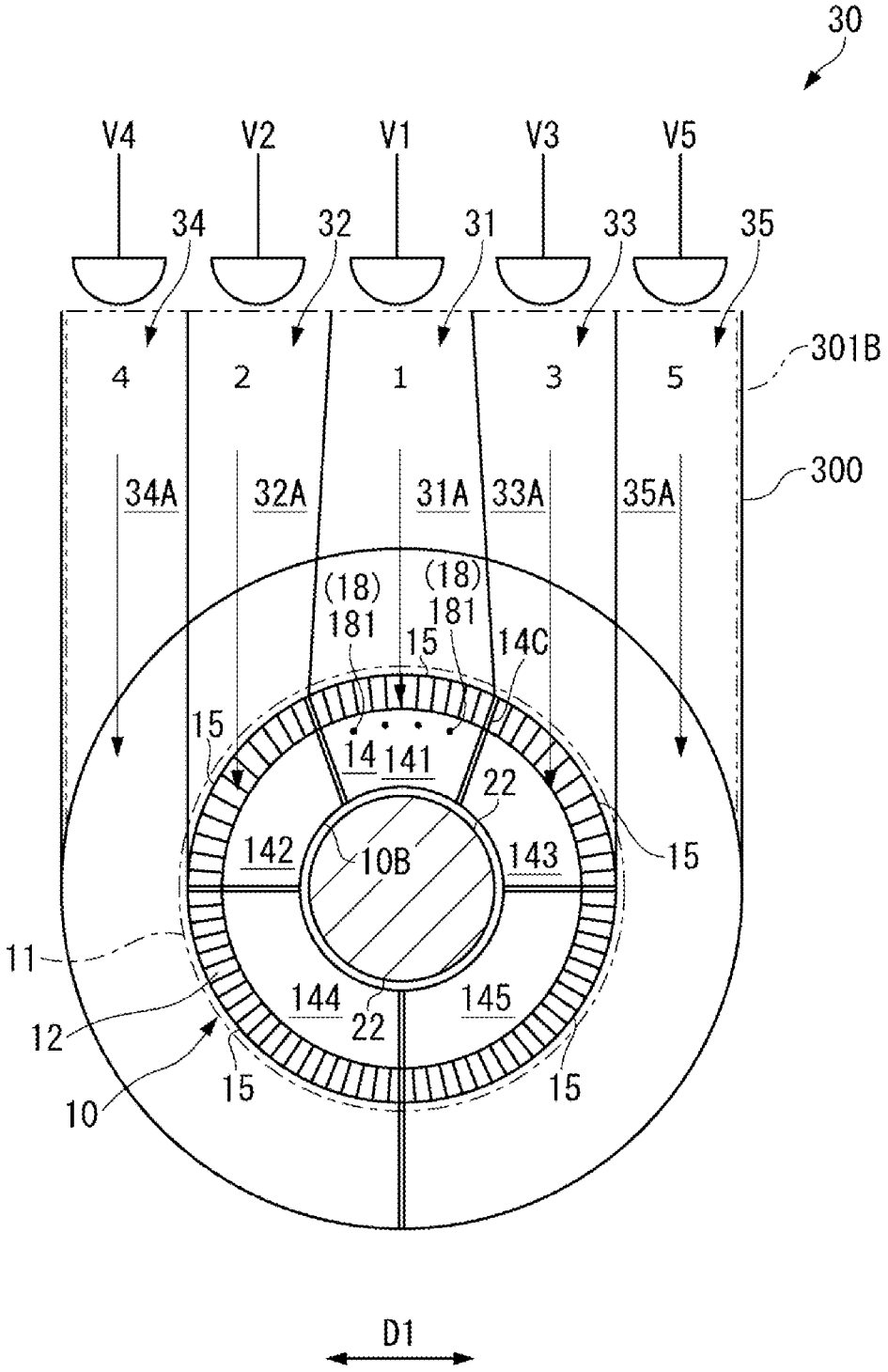
FIG. 4 is a plan view illustrating a modification of a bypass passage according to the present invention.

The through holes configuring the bypass passage 18 are not necessarily distributed over the entire circumference of the partition plate 10. As illustrated in FIG. 4, it is sufficient to provide the through holes 181 in at least a part of the partition plate 10 in the circumferential direction.

Figure 5:
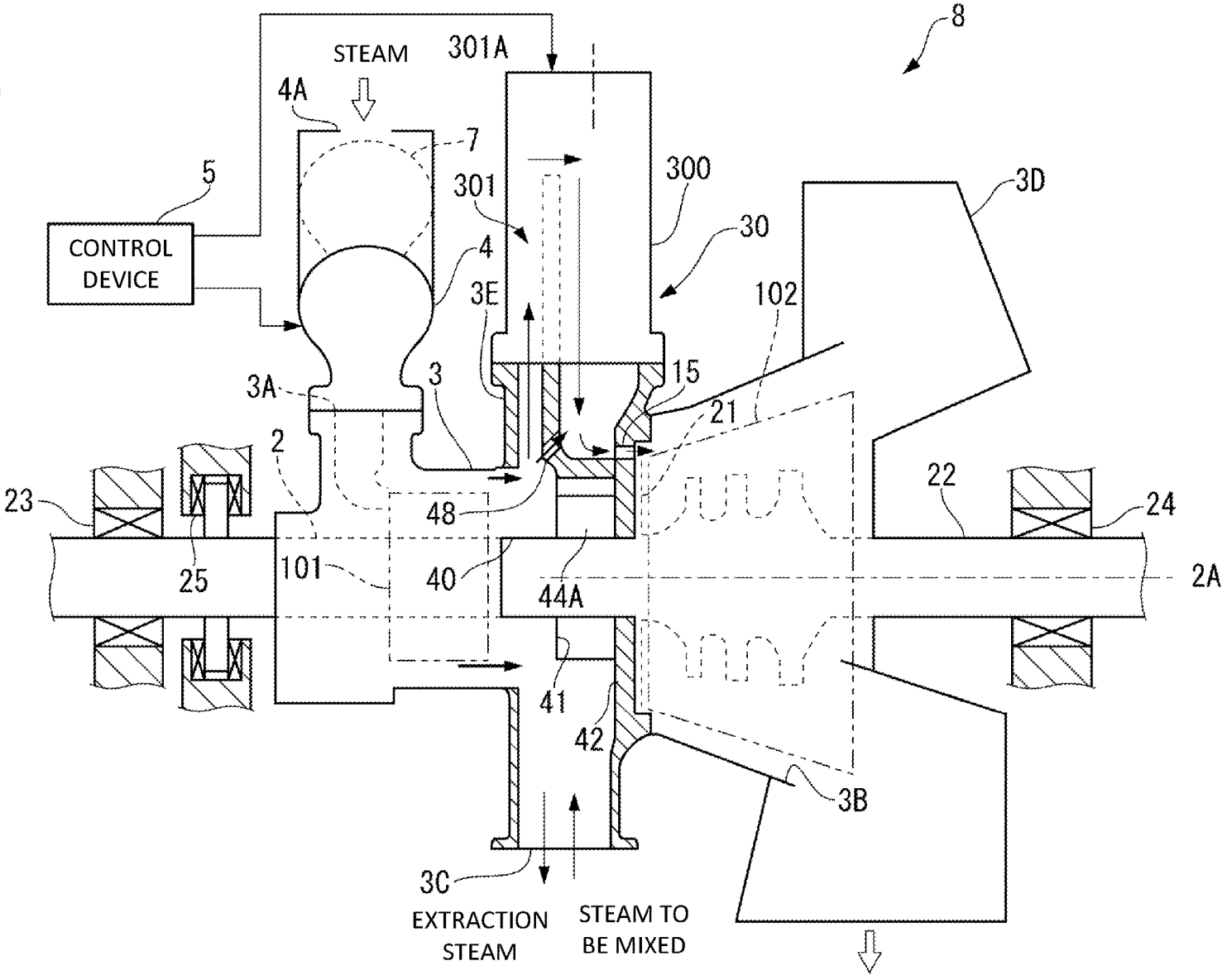
FIG. 5 is a diagram schematically illustrating a steam turbine according to a modification according to the present invention in a manner that a partition wall of a cabin and its vicinity are cut away.

The partition section according to the present invention may be configured as a partition section 40 that is formed integrally with the cabin 3 as illustrated in FIG. 5, in addition to the partition plate 10 disposed in the cabin 3 as described above.

The partition section 40 illustrated in FIG. 5 partitions the final stage of the high-pressure stage 101 and the first stage of the low-pressure stage 102, as with the partition plate 10, and includes a bypass passage 48 that makes the high-pressure stage 101 side and the low-pressure stage 102 side communicate with each other.

The partition section 40 is made thicker than the partition plate 10, and is fitted to a steam turbine 8 that is operated with the steam at pressure higher than the pressure of the above-described steam turbine 1 (FIG. 1). The steam turbine 8 also includes the pressure regulation valve 30 that regulates the pressure of the extraction steam or steam to be mixed through the port 3C.

The partition section 40 includes a high-pressure side partition part 41, a low-pressure side partition part 42, and a plurality of bulkheads 44A that divide a gap between the high-pressure side partition part 41 and the low-pressure side partition part 42. The high-pressure side partition part 41, the low-pressure side partition part 42, and the plurality of bulkheads 44A are formed integrally with the cabin 3 by casting.

The bypass passage 48 includes a plurality of through holes each penetrating through the high-pressure side partition part 41, the second parts 141 to 145 (see FIG. 2) that are divided in the circumferential direction and are a part of the flow path compartments of the pressure regulation valve 30, and the nozzles 15 prepared for the respective flow path compartments. The bypass passage 48 can be easily obtained only by providing the through holes in the high-pressure side partition part 41 of the existing partition wall.

As with the above-described embodiment, the steam on the high-pressure stage 101 side is introduced to the low-pressure stage 102 through the bypass passage 48, which makes it possible to achieve downsizing of the steam turbine. In addition, even if the introduction of the cooling steam through the pressure regulation valve 30 is stopped due to failure or the like, it is possible to secure the steam of the minimum flow rate necessary for cooling, in the low-pressure stage 102.

Other than the above description, the configurations described in the above-described embodiment can be selected or appropriately modified without departing from the scope of the present invention.

Figure 6:
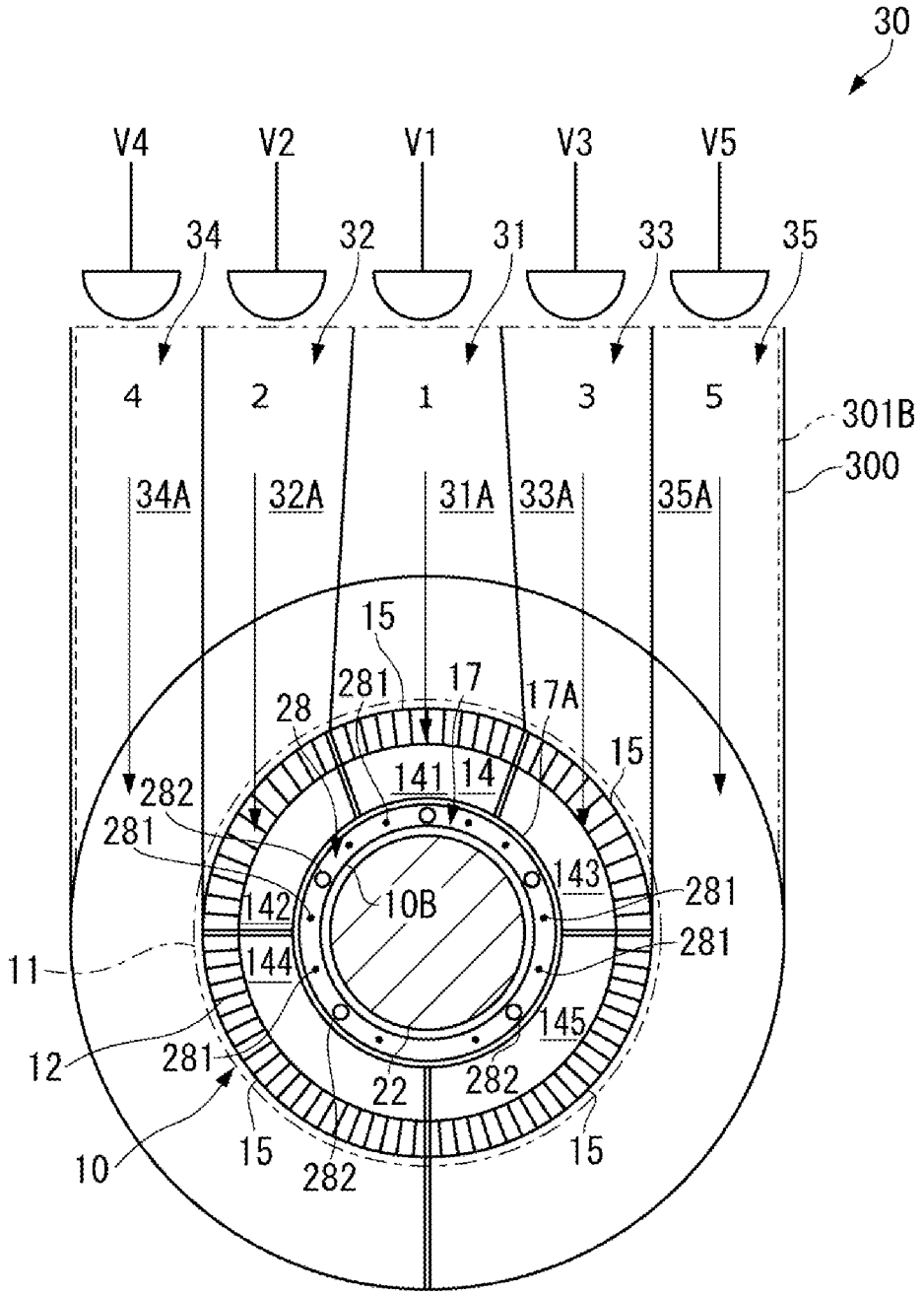
FIG. 6 is a plane view illustrating another modification of the bypass passage according to the present invention.
Figure 7:
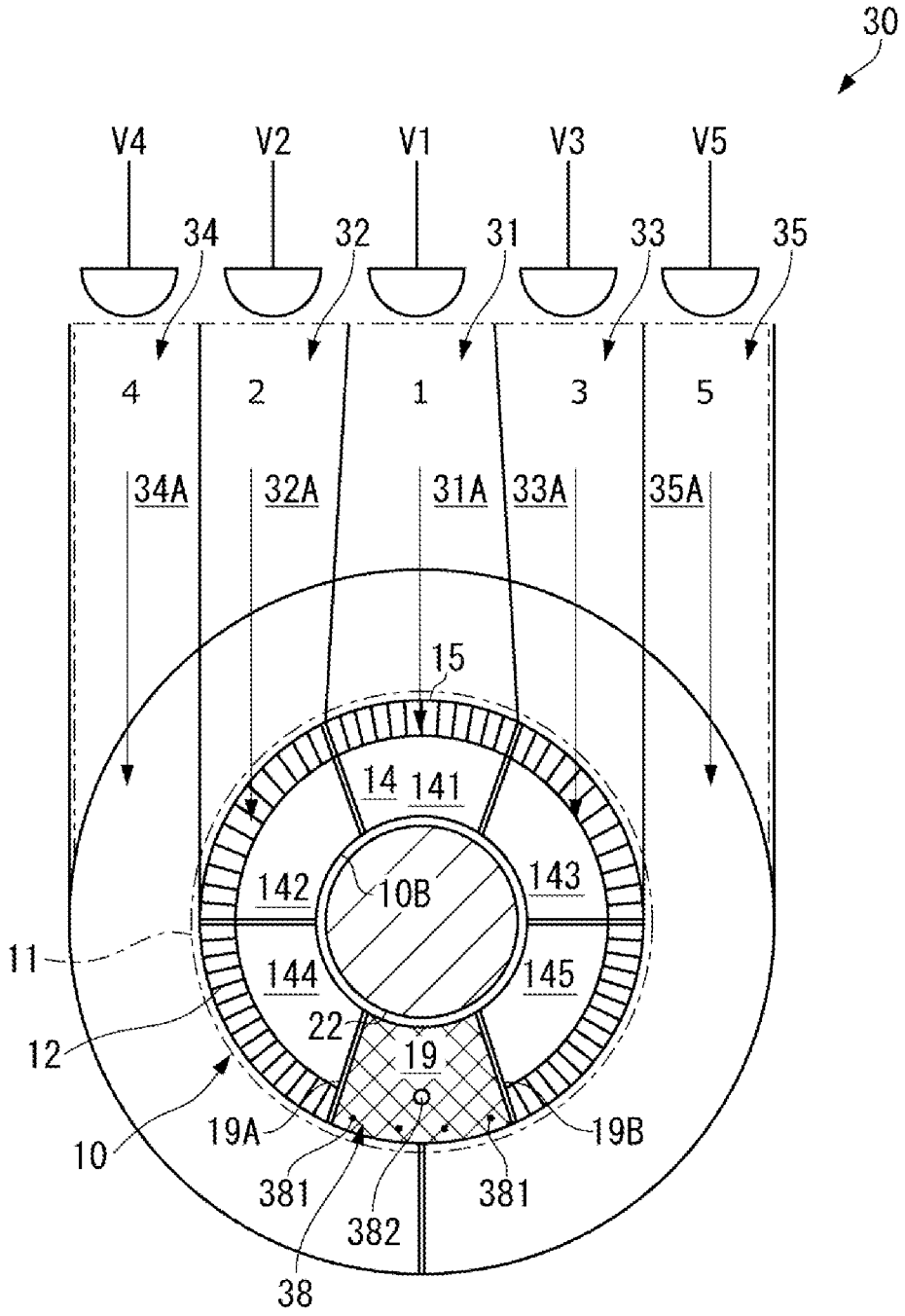
FIG. 7 is a plane view illustrating still another modification of the bypass passage according to the present invention.

The above-described bypass passage 18 (FIG. 2) and the above-described bypass passage 48 (FIG. 5) each include a part of the flow path of the pressure regulation valve 30, whereas a bypass passage 28 illustrated in FIG. 6 and a bypass passage 38 illustrated in FIG. 7 each do not include a part of the flow path of the pressure regulation valve 30.

The bypass passage 28 illustrated in FIG. 6 includes a bypass gap 17, through holes 281, and bypass introduction passages 282. The bypass gap 17 is a part of the gap 14 between the high-pressure side partition part 11 and the low-pressure side partition part 12. The through holes 281 make the high-pressure stage 101 side relative to the high-pressure side partition part 11 and the bypass gap 17 communicate with each other. The bypass introduction passages 282 lead from the bypass gap 17 to the low-pressure stage 102 side. The through holes 281 are distributed over the entire circumference of the high-pressure side partition part 11.

The bypass gap 17 is a ring-shaped space that is sectioned by a bulkhead 17A around the inner end 10B of the partition plate 10. The second parts 141 to 145 that are a part of the flow path of the pressure regulation valve 30 are disposed on the outer peripheral side relative to the bulkhead 17A.

The whole of the plurality of through holes 281, the plurality of bypass introduction passages 282, and the bypass gap 17 correspond to the bypass passage 28.

The bypass passage 38 illustrated in FIG. 7 includes a bypass gap 19 (region illustrated by lattice lines), through holes 381, and a bypass introduction passage 382. The bypass gap 19 is a part of the gap 14 between the high-pressure side partition part 11 and the low-pressure side partition part 12. The through holes 381 make the high-pressure stage 101 side relative to the high-pressure side partition part 11 and the bypass gap 19 communicate with each other. The bypass introduction passage 382 leads from the bypass gap 19 to the low-pressure stage 102 side.

The bypass gap 19 is a space sectioned in a part of the gap 14 in the circumferential direction by bulkheads 19A and 19B.

Also in a case where the bypass passage 28 illustrated in FIG. 6 or the bypass passage 38 illustrated in FIG. 7 is provided in the partition plate 10, the flow rate of the steam passing through the pressure regulation valve 30 is reduced by the flow rate of the steam introduced to the low-pressure stage 102 through the bypass passage 28 or 38, as with the above-described embodiment. Therefore, it is possible to secure the flow rate of the steam necessary to cool the low-pressure stage 102 while achieving downsizing of the steam turbine including the pressure regulation valve 30 in which the flow path is disposed over the entire circumference of the region including the outer peripheral side relative to the partition plate 10.

Note that the bypass passage 28 or the bypass passage 38 is applicable to the partition section 40 illustrated in FIG. 5.

The opening that makes the high-pressure stage 101 side relative to the high-pressure partition part and the gap 14 communicate with each other is not limited to a hole penetrating through the high-pressure side partition part 11, and may be a slit or a notch.

REFERENCE SIGNS LIST

1, 8 Steam turbine
2 Rotor
2A Axis
3 Cabin
3A Steam inlet
3B Steam outlet
3C Port
3D Outlet flow path part
3E Accommodation portion
4 Steam supply valve
4A Input port
5 Control device (control unit)
7 Shutoff valve
10 Partition plate (partition section, partition member)
10A Lower end part
10B Inner end

10C Labyrinth seal
11 High-pressure side partition part
11A Outer end
12 Low-pressure side partition part
13 Connection part
14 Gap
14A to 14E Bulkhead
15 Nozzle
18 Bypass passage
17, 19 Bypass gap
17A Bulkhead
19A Bulkhead
22 Rotary shaft
23, 24 Journal bearing
25 Thrust bearing
28 Bypass passage
30 Pressure regulation valve
30A Valve disc
30B Valve stem
31 to 35 Flow path compartment
31A, 32A, 33A, 34A, 35A First part
38 Bypass passage
39A to 39E Bulkhead
40 Partition section
41 High-pressure side partition part
42 Low-pressure side partition part
44A Bulkhead
48 Bypass passage
101 High-pressure stage
102 Low-pressure stage
141 to 145 Second part
181 Through hole (opening)
281 Through hole (opening)
282 Bypass introduction passage
300 Casing
301 Upward flow path (flow path)
301A Wall
301B Plate
381 Through hole (opening)
D1 Width direction
V1 to V5 Flow rate regulation valve
X Position

The invention claimed is:

1. A steam turbine, comprising:

a partition section that partitions a high-pressure stage to which steam is supplied, and a low-pressure stage to which the steam passed through the high-pressure stage is introduced; and a pressure regulation valve configured to regulate pressure of extraction steam that is a part of the steam passed through the high-pressure stage or pressure of steam to be mixed flowing from outside into the steam passed through the high-pressure stage, wherein the pressure regulation valve includes:

an upward flow path that guides the steam from the high-pressure stage side to a predetermined position separated outward in a radial direction from an outer end of the partition section;

a plurality of flow rate regulation valves that are provided at the predetermined position located on outer peripheral side relative to the partition section and to which the steam is guided from the high-pressure stage side relative to the partition section; and a plurality of flow path compartments that:

correspond to the respective flow rate regulation valves, communicate with the low-pressure stage side relative to the partition section through respective nozzle holes, and guide the steam passed through the respective flow rate regulation valves to the low-pressure stage, the plurality of flow path compartments are arranged over the entire partition section in a circumferential direction in a region including the outer peripheral side relative to the partition section as a whole, the partition section includes a bypass passage that makes the high-pressure stage side and the low-pressure stage side communicate with each other without passing through the pressure regulation valve, the plurality of flow path compartments include:

first parts that extend in parallel from the position of the flow rate regulation valves toward the partition section;

second parts that are formed by dividing, in the circumferential direction, a space between a high-pressure side partition part of the partition section facing the high-pressure stage and a low-pressure side partition part of the partition section facing the low-pressure stage; and the nozzle holes for the steam that are prepared for the respective flow path compartments and lead from the respective second parts to the low-pressure stage side, the partition section is a partition member that is formed integrally with a cabin accommodating the high-pressure stage and the low-pressure stage, or a partition member provided separately from the cabin, the partition section further includes the high-pressure side partition part facing the high-pressure stage and the low-pressure side partition part facing the low-pressure stage, and the bypass passage includes:

openings that make the high-pressure stage side relative to the high-pressure side partition part and the second parts located between the high-pressure side partition part and the low-pressure side partition part, communicate with each other; and the nozzle holes that lead from the respective second parts to the low-pressure stage side.

2. The steam turbine according to claim 1, further comprising:

a control unit configured to increase or decrease an opening of each of the plurality of flow rate regulation valves, wherein the control unit regulates the flow rate of the steam to be introduced to the low-pressure stage through the pressure regulation valve, from a minimum flow rate when the plurality of flow rate regulation valves are all fully closed to a maximum flow rate when the plurality of flow rate regulation valves are all fully opened.

3. The steam turbine according to claim 1, further comprising a casing that is provided to a cabin and accommodates an entirety of the pressure regulation valve, the cabin accommodating the high-pressure stage and the low-pressure stage, wherein the upward flow path is sectioned, near a final stage of the high-pressure stage, among a wall that rises over a part of the cabin and the casing, an upper part of the high-pressure side partition part and a part that is continued upward from the upper part of the high-pressure side partition part.

4. The steam turbine according to claim 1, wherein positions of the openings are set on an inside of positions of the nozzle holes in the radial direction.

5. The steam turbine according to claim 1, wherein the openings are distributed over an entire circumference or a part of the circumference of the high-pressure side partition part.

6. A partition member for a steam turbine that partitions a high-pressure stage to which steam is supplied and a low-pressure stage to which the steam passed through the high-pressure stage is introduced, and is used in the steam turbine including a pressure regulation valve configured to regulate pressure of extraction steam or pressure of steam to be mixed, the partition member comprising:

a bypass passage configured to make the high-pressure stage side and the low-pressure stage side communicate with each other without passing through the pressure regulation valve that is disposed in a region including outer peripheral side relative to the partition member;

a high-pressure side partition part facing the high-pressure stage; and a low-pressure side partition part facing the low-pressure stage, wherein the partition member is an annular member provided separately from a cabin accommodating the high-pressure stage and the low-pressure stage, and the bypass passage includes:

openings that make the high-pressure stage side relative to the high-pressure side partition part and a gap between the high-pressure side partition part and the low-pressure side partition part, communicate with each other; and a nozzle hole for the steam that leads from the gap to the low-pressure stage side.

7. The partition member for the steam turbine according to claim 6, wherein the openings are distributed over an entire circumference or a part of the circumference of the high-pressure side partition part.

8. A method for operating a steam turbine, the steam turbine including a partition section that partitions a high-pressure stage to which steam is supplied, and a low-pressure stage to which the steam passed through the high-pressure stage is introduced, and a pressure regulation valve configured to regulate pressure of a first steam or a second steam, the first steam being extraction steam that is a part of the steam passed through the high-pressure stage, the second steam being steam to be mixed flowing from outside into the steam passed through the high-pressure stage, the pressure regulation valve includes:

a plurality of flow rate regulation valves that are located on outer peripheral side relative to the partition section and to which the first steam or the second steam is guided from the high-pressure stage side relative to the partition section; and a plurality of flow path compartments that:

correspond to the respective flow rate regulation valves, and communicate with the low-pressure stage side relative to the partition section through respective nozzle holes, and guide the first steam or the second steam passed through the respective flow rate regulation valves to the low-pressure stage, the plurality of flow path compartments are arranged over the entire partition section in a circumferential direction in a region including the outer peripheral side relative to the partition section as a whole, the plurality of flow path compartments include:

first parts that extend in parallel from the position of the flow rate regulation valves toward the partition section;

second parts that are formed by dividing, in the circumferential direction, a space between a high-pressure side partition part of the partition section facing the high-pressure stage and a low-pressure side partition part of the partition section facing the low-pressure stage; and the nozzle holes for the first steam or the second steam that are prepared for the respective flow path compartments and lead from the respective second parts to the low-pressure stage side, the partition section is a partition member that is formed integrally with a cabin accommodating the high-pressure stage and the low-pressure stage, or a partition member provided separately from the cabin, the partition section includes the high-pressure side partition part facing the high-pressure stage and the low-pressure side partition part facing the low-pressure stage, and the partition section further includes:

a bypass passage including:

openings that make the high-pressure stage side relative to the high-pressure side partition part and the second parts located between the high-pressure side partition part and the low-pressure side partition part, communicate with each other; and the nozzle holes that lead from the respective second parts to the low-pressure stage side, the method comprising:

controlling the pressure of the first steam or the second steam by regulating a flow rate of the steam to be introduced to the low-pressure stage through the pressure regulation valve that is disposed in a region including outer peripheral side relative to the partition section; and constantly introducing the steam from the high-pressure stage side to the low-pressure stage side through the bypass passage provided in the partition section without passing through the pressure regulation valve while the high-pressure stage and the low-pressure stage are rotated.

9. The method for operating the steam turbine according to claim 8, wherein, even when the flow rate of the steam to be introduced to the low-pressure stage through the pressure regulation valve is insufficient for a predetermined flow rate necessary to cool the low-pressure stage, the predetermined flow rate of the steam to be introduced to the low-pressure stage is secured by the steam introduced to the low-pressure stage side through the bypass passage.

* * * * *